US006786189B2

(12) United States Patent
Matsuto et al.

(10) Patent No.: US 6,786,189 B2
(45) Date of Patent: Sep. 7, 2004

(54) INTERNAL COMBUSTION ENGINE

(75) Inventors: Takushi Matsuto, Saitama (JP); Ryo Kubota, Saitama (JP); Toshio Shimada, Saitama (JP); Masatoshi Suzuki, Saitama (JP); Naoto Hara, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/178,709

(22) Filed: Jun. 25, 2002

(65) Prior Publication Data

US 2003/0005905 A1 Jan. 9, 2003

(30) Foreign Application Priority Data

Jul. 5, 2001 (JP) ..... 2001-205174

Jul. 5, 2001 (JP) ..... 2001-205175

(51) Int. Cl.[7] ..... F02B 75/32
(52) U.S. Cl. ..... 123/197.1
(58) Field of Search ..... 123/54.1, 54.4, 123/54.6, 55.2, 55.5, 55.7, 53.1, 197.1, 197.4, 51 B, 192.2

(56) References Cited

U.S. PATENT DOCUMENTS 4,694,785 A * 9/1987 Timmerman et al. ..... 123/53.2
5,092,293 A * 3/1992 Kaniut ..... 123/198 F

FOREIGN PATENT DOCUMENTS

JP 2000-110661 4/2000

* cited by examiner

*Primary Examiner*—Tony M. Argenbright
*Assistant Examiner*—Hyder Ali
(74) *Attorney, Agent, or Firm*—Birch, Stewart, Kolasch & Birch, LLP

(57) ABSTRACT

A piston slidably fitted in a cylinder is connected to an auxiliary piston slidably fitted in an auxiliary cylinder coaxial with the cylinder through a first connecting rod. The left and right crankshaft halves are disposed outside of a piston sliding range of the cylinder with respect to the radial direction thereof. The increase of the volume of a combustion chamber corresponding to the increase of the crank angle with reference to top dead center of the piston is suppressed, and it is therefore possible to enhance the equal volume degree at the time of combustion of a mixture gas and to enhance thermal efficiency. This arrangement also enhances thermal efficiency, and simplifies the structures of intake systems and valve mechanisms when employed in horizontally opposed type internal combustion engine.

10 Claims, 12 Drawing Sheets

A: Top dead center

B: Bottom dead center

C: Middle point

A: Crank angle

B: Piston displacement

C: Top dead center

D: Bottom dead center

E: Present invention

F: Prior-art example

G: Sine curve

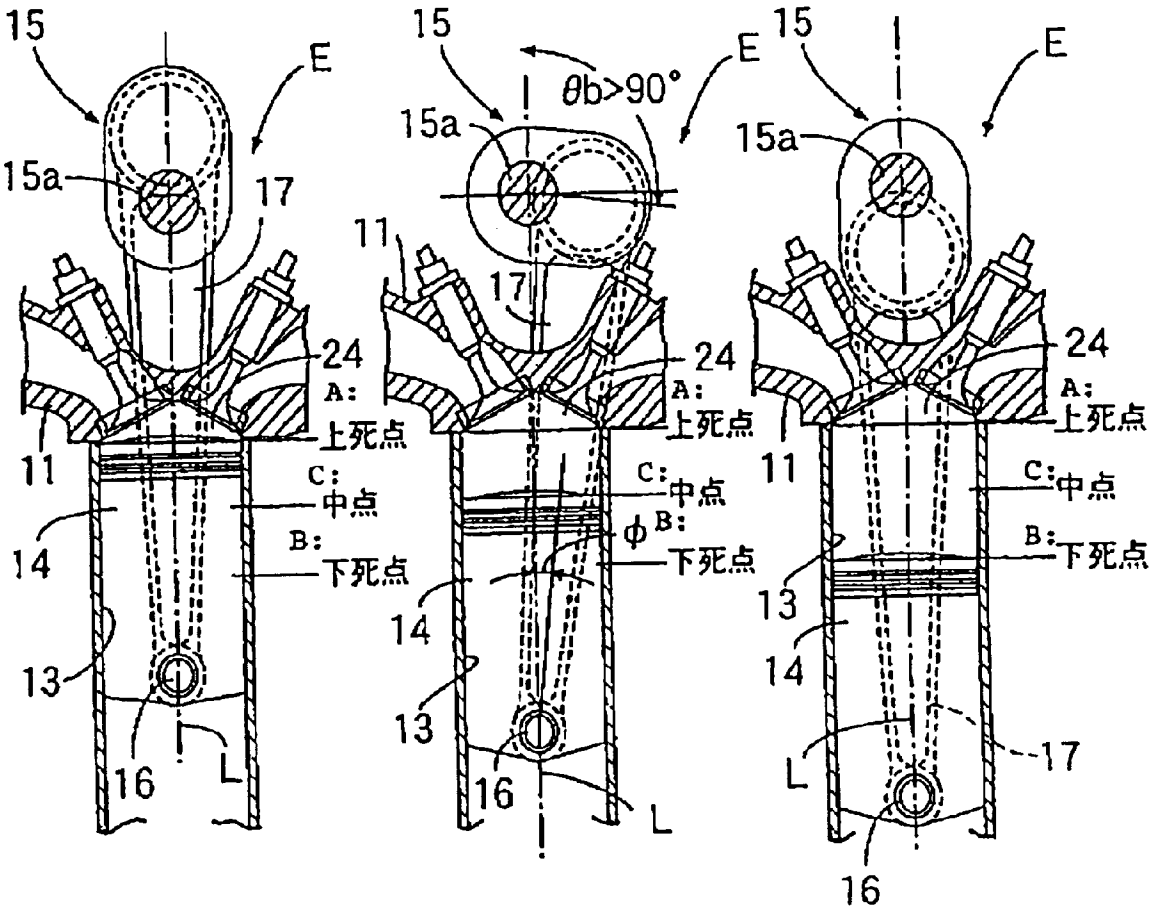
A: Top dead center
B: Bottom dead center
C: Middle point

INTERNAL COMBUSTION ENGINE

BACKGROUND OF THE INVENTION

CROSS-REFERENCES TO RELATED APPLICATIONS

This nonprovisional application claims priority under 35 U.S.C. §119(a) on Patent Application No. 2001-205174 filed in Japan on Jul. 5, 2001, and Patent Application No. 2001-205175 filed in Japan on Jul. 5, 2001, the entirety of each of which are herein incorporated by reference.

1. Field of the Invention

The present invention relates to an internal combustion engine, and more particularly to an internal combustion engine in which a piston slidably fitted in a cylinder is connected to a crankshaft through a connecting rod. The present invention specifically relates to a horizontally-opposed type internal combustion engine in which left and right pistons are slidably supported in left and right cylinder banks horizontally opposed to each other. A crankshaft is positioned between the pistons and is connected to the pistons through connecting rods.

2. Description of the Background Art

A horizontally-opposed type internal combustion engine has been known in the background art, e.g., as seen by the exemplary engine described in Japanese Patent Laid-open No. 2000-110661. The engine described in Japanese Patent Laid-open No. 2000-110661 has a structure in which left and right cylinders are disposed on both sides of a crankshaft. Pistons slidably fitted in the cylinders are each connected to the crankshaft through a connecting rod. A combustion chamber of each of the cylinders is provided at an end portions of the cylinders on the opposite side of the crankshaft. Therefore, each of the pistons is moved in the direction of approaching the crankshaft during an expansion stroke.

FIG. 7 is a schematic view of a general 4-cycle single-cylinder internal combustion engine according to the background art. The internal combustion engine E includes a cylinder 01, a piston 02 slidably fitted in the cylinder 01, a cylinder head 03 connected to the cylinder 01, a combustion chamber 04 provided between a lower surface of the cylinder head 03 and the cylinder 01, a crankshaft 05, and a connecting rod 06 for connecting the piston 02 to the crankshaft 05. The piston 02 is located at a position between the cylinder head 03 and the crankshaft 05.

FIG. 7(*a*) shows a condition where the piston 02 is located at a position of top dead center, e.g., when the crank angle θ is 0°. FIG. 7(*c*) shows a condition where the piston 02 is located at a position of bottom dead center, e.g., when the crank angle θ is 180° (Position C in FIGS. 7(*a*)–(*c*). FIG. 7(*b*) shows a condition where the piston 02 is located at a middle position (Position B in FIGS. 7(*a*)–(*c*) between top dead center (Position A in FIGS. 7(*a*)–(*c*)) and bottom dead center (Position C), e.g., when the crank angle θ is not 90° but is an angle θa less than 90°. While the connecting rod 06 is on the axis L1 of the cylinder 01 at top dead center and bottom dead center, the connecting rod 06 is inclined by an angle ϕ relative to the axis L1 of the cylinder 01 at the middle position.

In FIG. 6, the relationship between the crank angle θ with reference to top dead center of the internal combustion engine E and the displacement x of the piston 02 with reference to top dead center is indicated by a chain line. The stroke between top dead center and bottom dead center of the piston 02 is 2R (R is the crank radius). As has been described with reference to FIG. 7(*b*), when the piston 02 is located at the middle position, e.g., any intermediate point between, between top dead center and bottom dead center, e.g., at a point where the displacement x of the piston 02 is R, the crank angle θ is an angle θa which is less than 90°. In contrast, in a sine curve ($x=R\sin(\theta-90°)+R$) indicated by a solid line, the crank angle θ is 90° when the piston 02 is located at the middle position between top dead center and bottom dead center.

Accordingly, in the case of the internal combustion engine E of the background art, the line (see the chain line) representing the relationship of the displacement x of the piston 02 to the crank angle θ is located on the upper side relative to the sine curve indicated by the solid line. When the piston 02 is lowered from top dead center in the beginning stage of the expansion stroke, the increase of the displacement x of the piston 02 with reference to the increase of the crank angle θ is greater when compared with the characteristics of the sine curve.

The present inventors have identified the following problems associated with the background art. In the internal combustion engine E of the background art shown in FIG. 7, the crankshaft 05 is disposed on the lower side of the direction of the axis L1 of the cylinder 01. Therefore, the engine E, and the mass dispersed in the direction of the axis L1, is enlarged in size in the direction of the axis L1.

In addition, in order to enhance thermal efficiency of an internal combustion engine E, it is desirable to enhance the degree of an equal volume of a mixture gas at the time of combustion. The volume of the combustion chamber 04 on the upper side of the piston 02 is increased when the combustion of the mixture gas is started in the vicinity of top dead center of the piston 02 and the piston 02 is lowered. Accordingly, the equal volume is higher and thermal efficiency is higher as the increase of the volume of the combustion chamber 04 with reference to the increase of the crank angle θ is smaller. However, in the case of the internal combustion engine E of the background art, the increase of the volume of the combustion chamber 04 with reference to the increase of the crank angle θ from top dead center is enlarged and the equal volume degree is lowered. This arrangement is disadvantageous for enhancing the thermal efficiency of the internal combustion engine E.

The horizontal opposed type internal combustion engine described in Japanese Patent Laid-open No. 2000-110661 also suffers from the above-mentioned problems because it employs a structure in which the general single-cylinder internal combustion engines according to the prior art simply combine a pair of pistons opposed to each other.

Further, the horizontal opposed type internal combustion engine described in Japanese Patent Laid-open No. 2000-110661 requires complicated structures for the intake system and the valve mechanism, because the left and right cylinder heads are located away from each other.

SUMMARY OF THE INVENTION

The present invention overcomes the shortcomings associated with the background art and achieves other advantages not realized by the background art.

An object of the present invention is to reduce the size of an internal combustion engine in the axial direction of the cylinder.

An object of the present invention is to enhance the equal volume degree at the time of combustion of a mixture gas of the internal combustion engine and to enhance thermal efficiency.

An additional object of the present invention is to provide the aforementioned improvements and advantages for a horizontally opposed type internal combustion engine. Specifically, an object of the present invention is to enhance the equal volume degree at the time of combustion of a mixture gas in a horizontal opposed type internal combustion engine, enhance thermal efficiency thereof, and to simplify the structures of the associated intake system and valve mechanism.

One or more of these and other objects are accomplished by an internal combustion engine comprising a cylinder; a cylinder head; a piston slidably fitted in the cylinder; an auxiliary cylinder coaxial with the cylinder; an auxiliary piston slidably fitted in the auxiliary cylinder; a first connecting rod integrating the piston and the auxiliary piston into a single unitary body; a combustion chamber provided in the cylinder head; a pair of left and right crankshaft halves; and a pair of second connecting rods connecting the auxiliary piston to the left and right crankshaft halves through an intermediate pin, wherein the left and right crankshaft halves are disposed along the outside of the cylinder with respect to a radial direction thereof and a piston sliding range of the cylinder.

One or more of these and other objects are accomplished by an internal combustion engine comprising a piston slidably fitted in a cylinder; a combustion chamber; a crankshaft; and a connecting rod connecting the piston to the crankshaft, wherein the crankshaft is positioned adjacent to the combustion chamber and outside of a piston sliding range of the cylinder with respect to a radial direction of the cylinder.

One or more of these and other objects are accomplished by a horizontally opposed internal combustion engine comprising a left cylinder block horizontally opposed to a right cylinder block; a left cylinder positioned in a left cylinder bank; a right cylinder positioned in a right cylinder bank; left and right pistons slidably supported respectively in the cylinders; a crankshaft positioned between the left and right pistons, the left and right pistons being connected to the crankshaft through a connecting rod; and left and right combustion chambers being provided between the left and right cylinders so that the left and right pistons are capable of being moved in opposite directions away from the crankshaft during an expansion stroke of the left and right pistons.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein:

FIG. 12 is an operational view of an internal combustion engine according to the present invention.

DETAILED DESCRIPTION OF THE PREFERRED EMBODIMENTS

Figure 1:
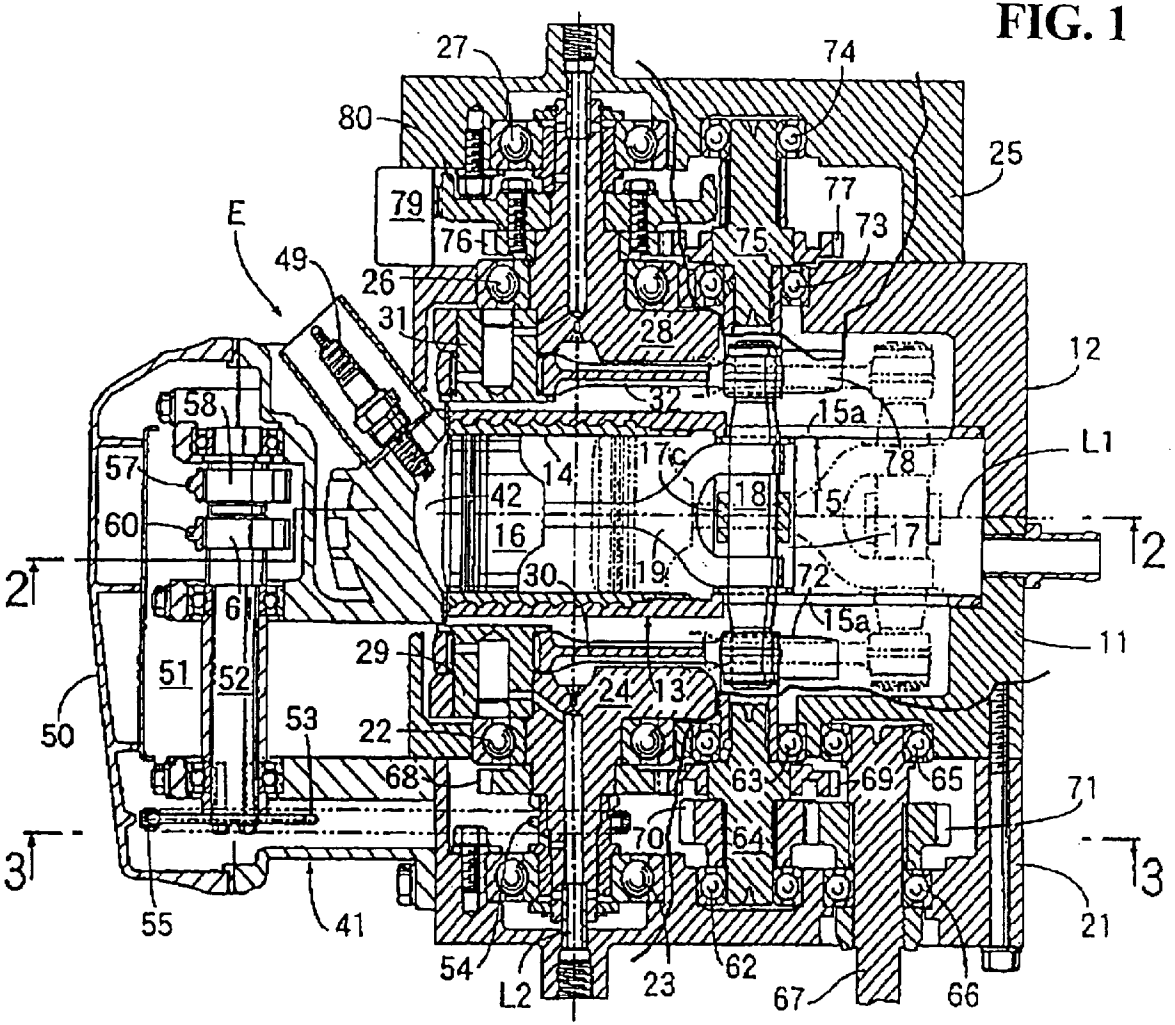
FIG. 1 is a horizontal sectional view of an internal combustion engine for a motorcycle according to an embodiment of the present invention.
Figure 2:
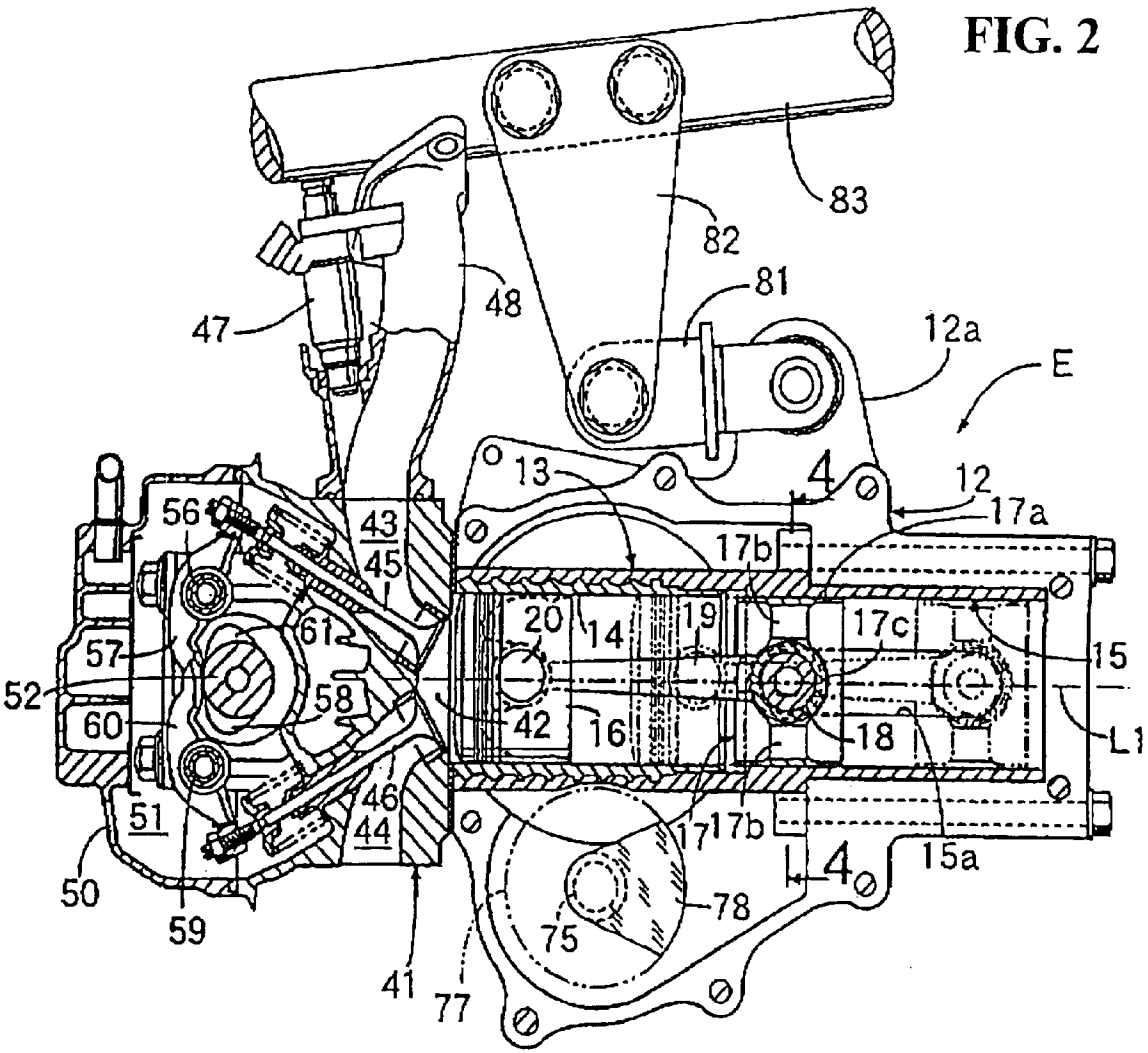
FIG. 2 is a sectional view taken along line 2—2 of FIG. 1.
Figure 3:
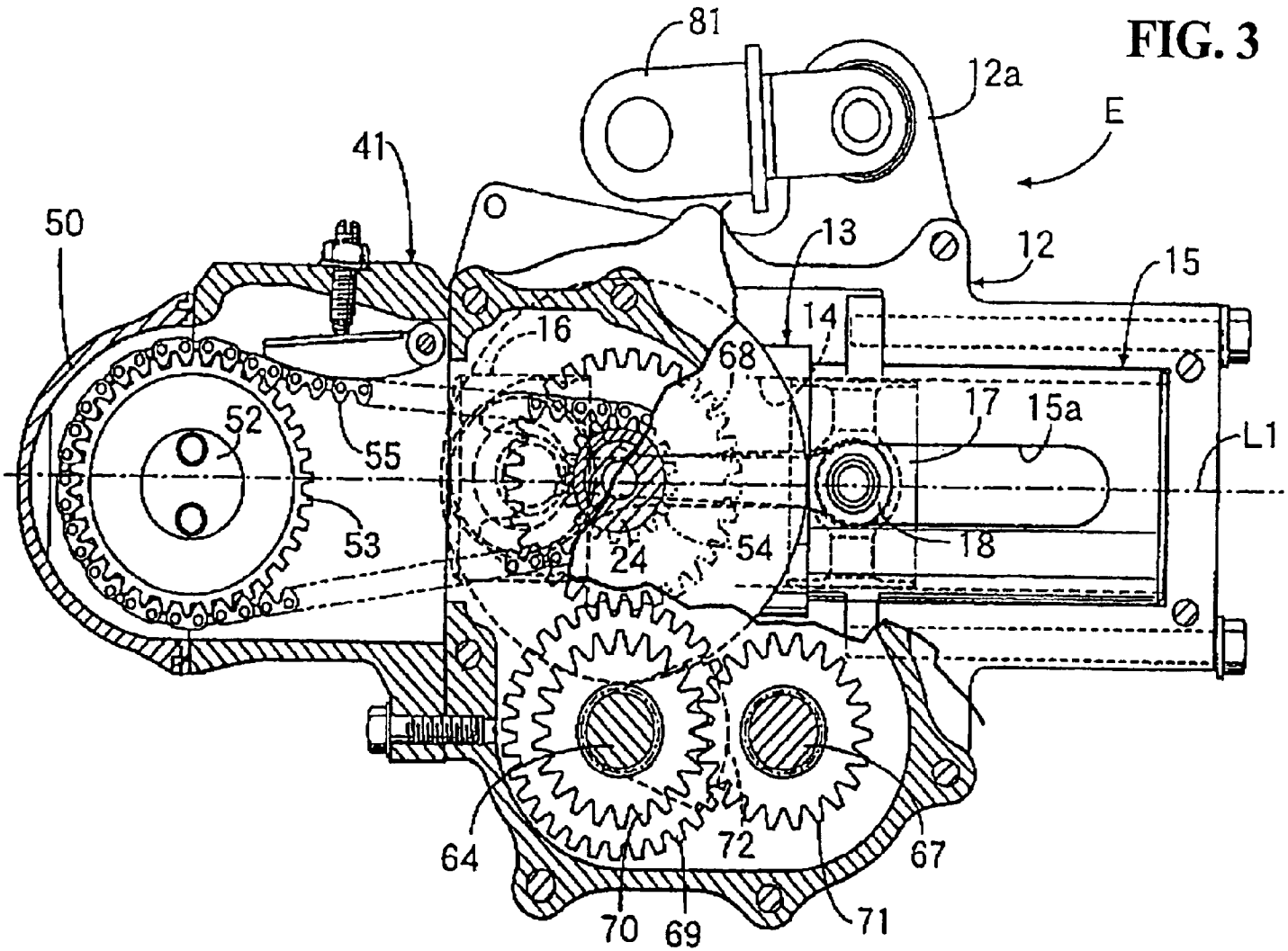
FIG. 3 is a sectional view taken along line 3—3 of FIG. 1.
Figure 4:
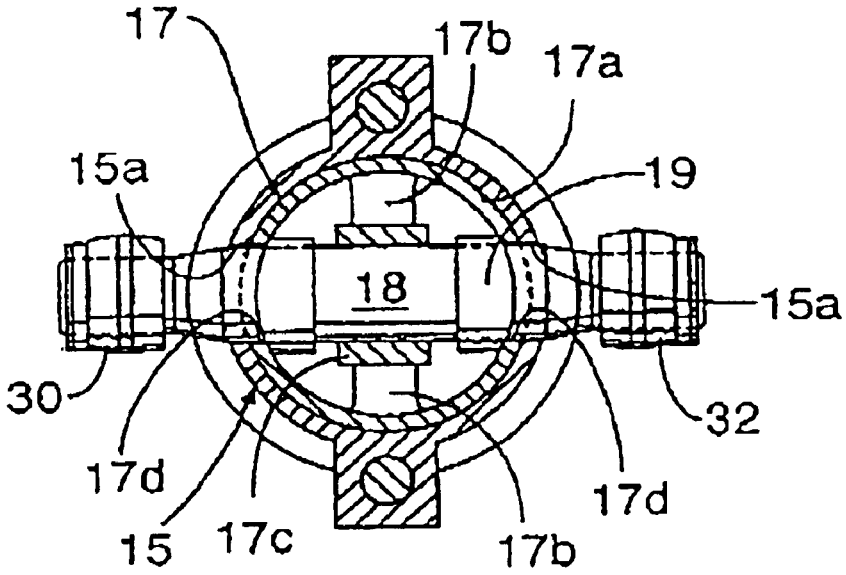
FIG. 4 is a sectional view taken along line 4—4 of FIG. 2.
Figure 5A:
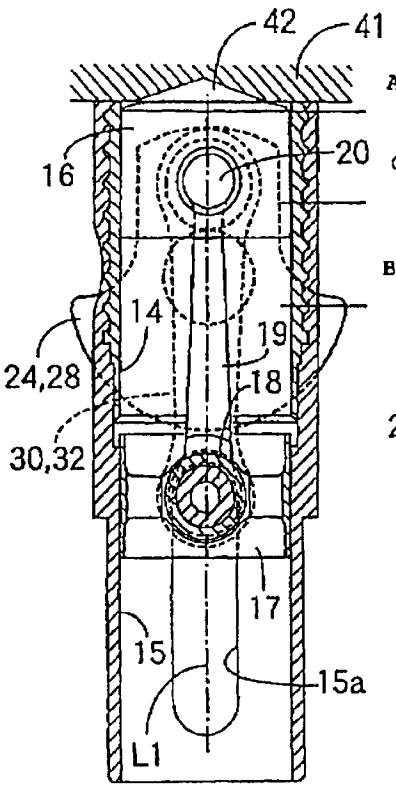
FIG. 5 is an operational view of an internal combustion engine according to the present invention.
Figure 5B:
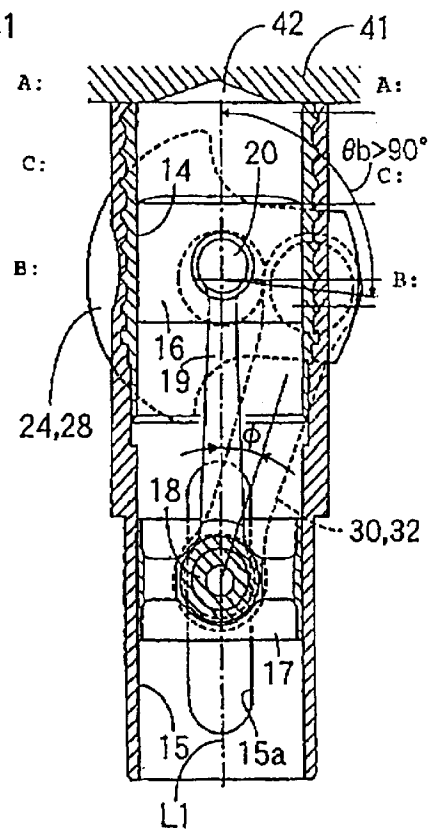
Figure 5C:
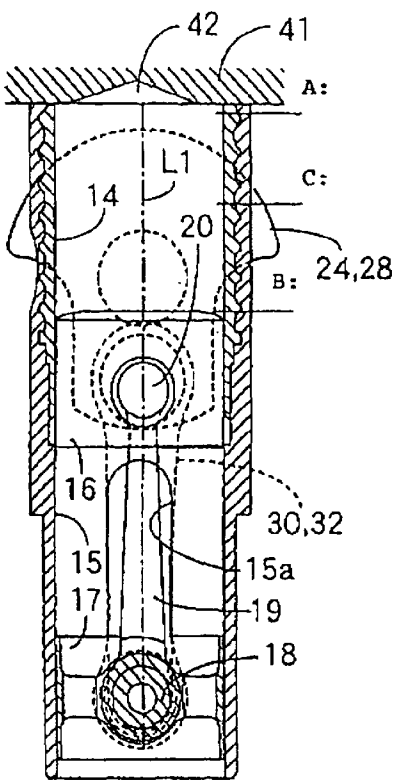
Figure 6:
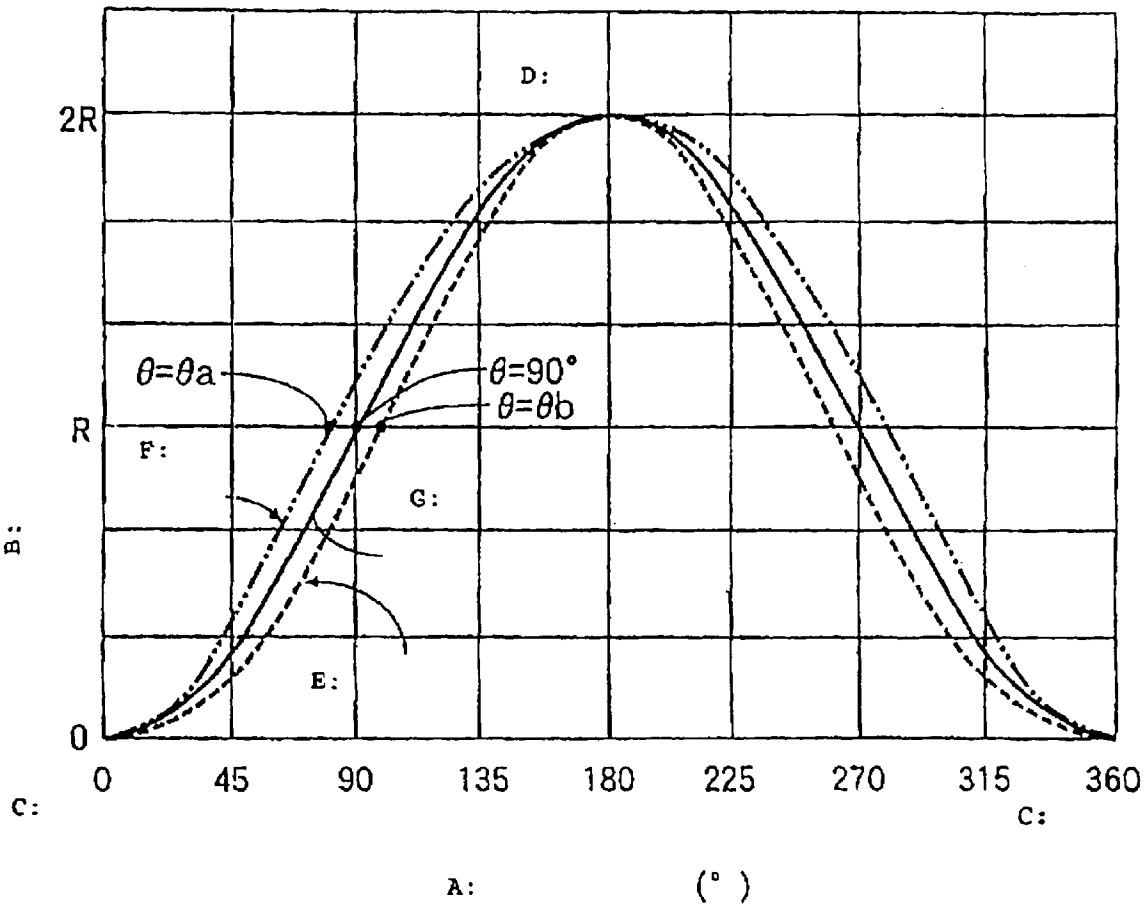
FIG. 6 is a graphical view showing a comparative relationship between crank angle θ and piston displacement x for internal combustions of the present invention and according to the background art.
Figure 7A:
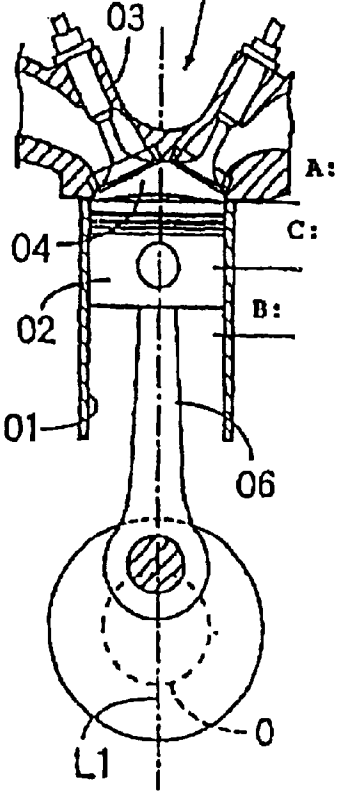
FIG. 7(A) BACKGROUND ART
FIG. 7 is a schematic view of the operation of a general 4-cycle single-cylinder internal combustion engine according to the background art.
Figure 7B:
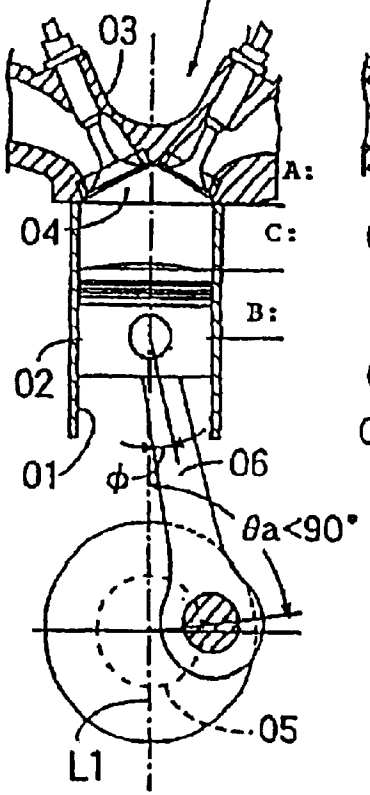
FIG. 7(B) BACKGROUND ART
Figure 7C:
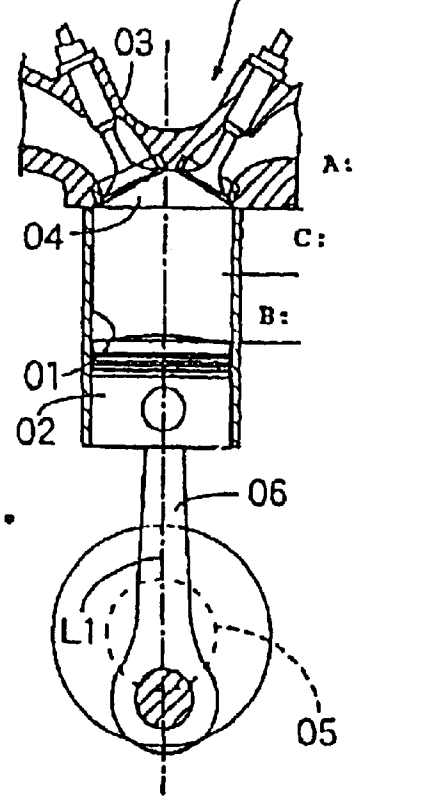
FIG. 7(C) BACKGROUND ART

The present invention will hereinafter be described with reference to the accompanying drawings. FIGS. 1 to 6 show a first embodiment of the present invention. FIG. 1 is a horizontal sectional view of an internal combustion engine for a motorcycle according to an embodiment of the present invention. FIG. 2 is a sectional view taken along line 2—2 of FIG. 1. FIG. 3 is a sectional view taken along line 3—3 of FIG. 1. FIG. 4 is a sectional view taken along line 4—4 of FIG. 2. FIG. 5 is an operational view of an internal combustion engine according to the present invention. FIG. 6 is a graphical view showing a relationship between crank angle θ and piston displacement x. FIG. 7 is a schematic view of the operation of a general 4-cycle single-cylinder internal combustion engine according to the background art.

Figure 8:
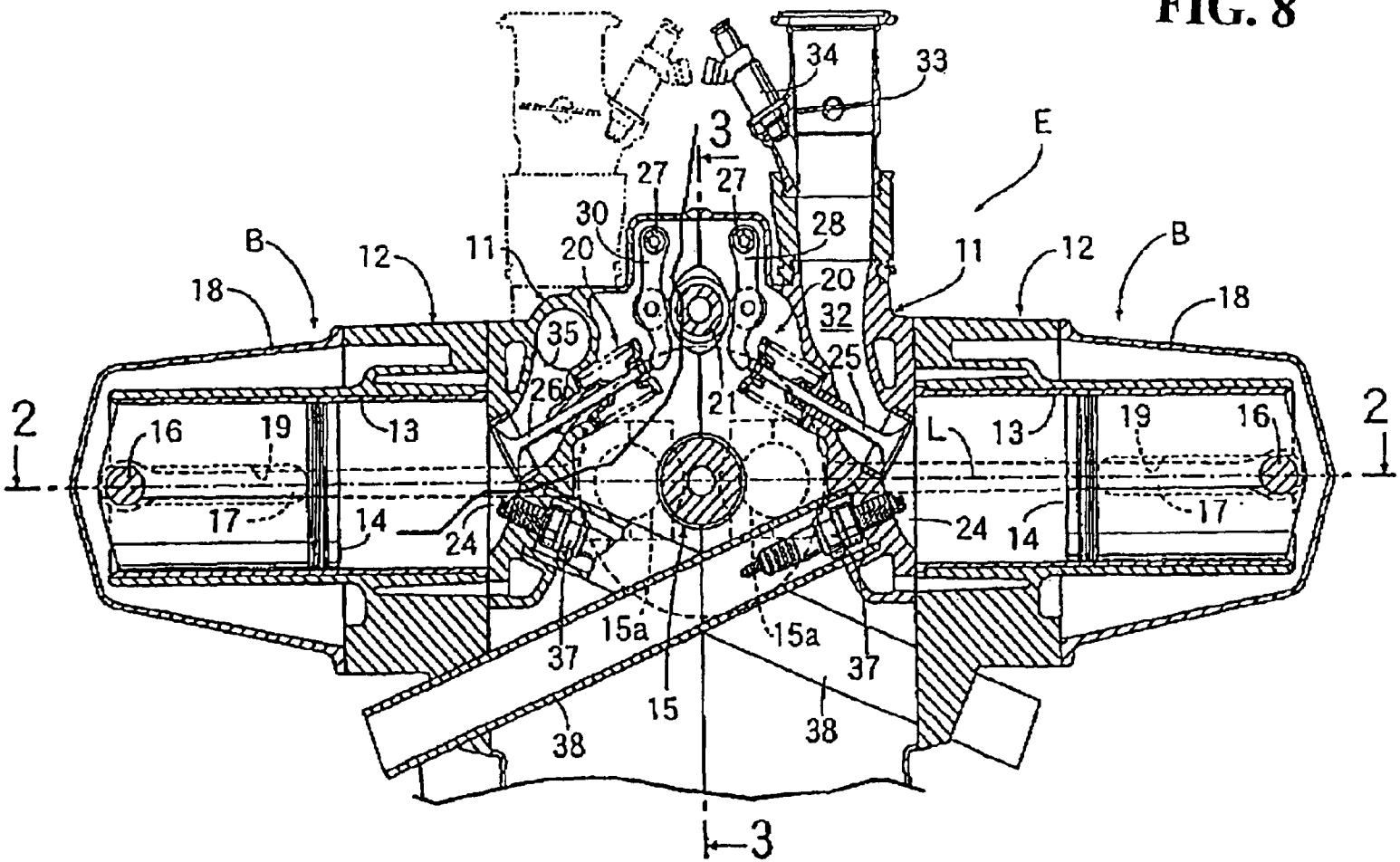
FIG. 8 is a vertical sectional view of a horizontally-opposed type, internal combustion engine during an operating condition where a piston is located at bottom dead center.
Figure 9:
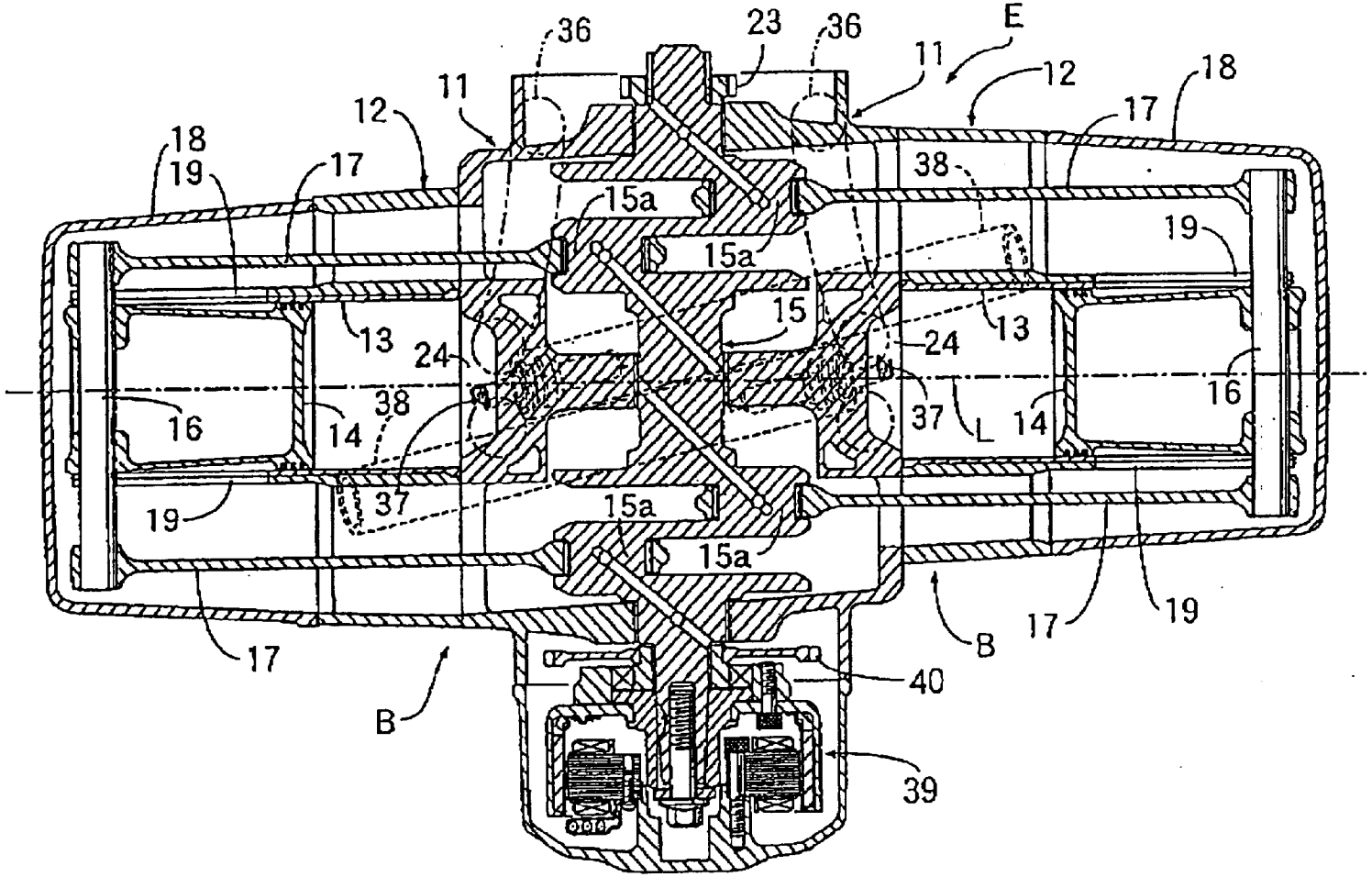
FIG. 9 is a vertical sectional view taken along line 2—2 of FIG. 8.
Figure 10:
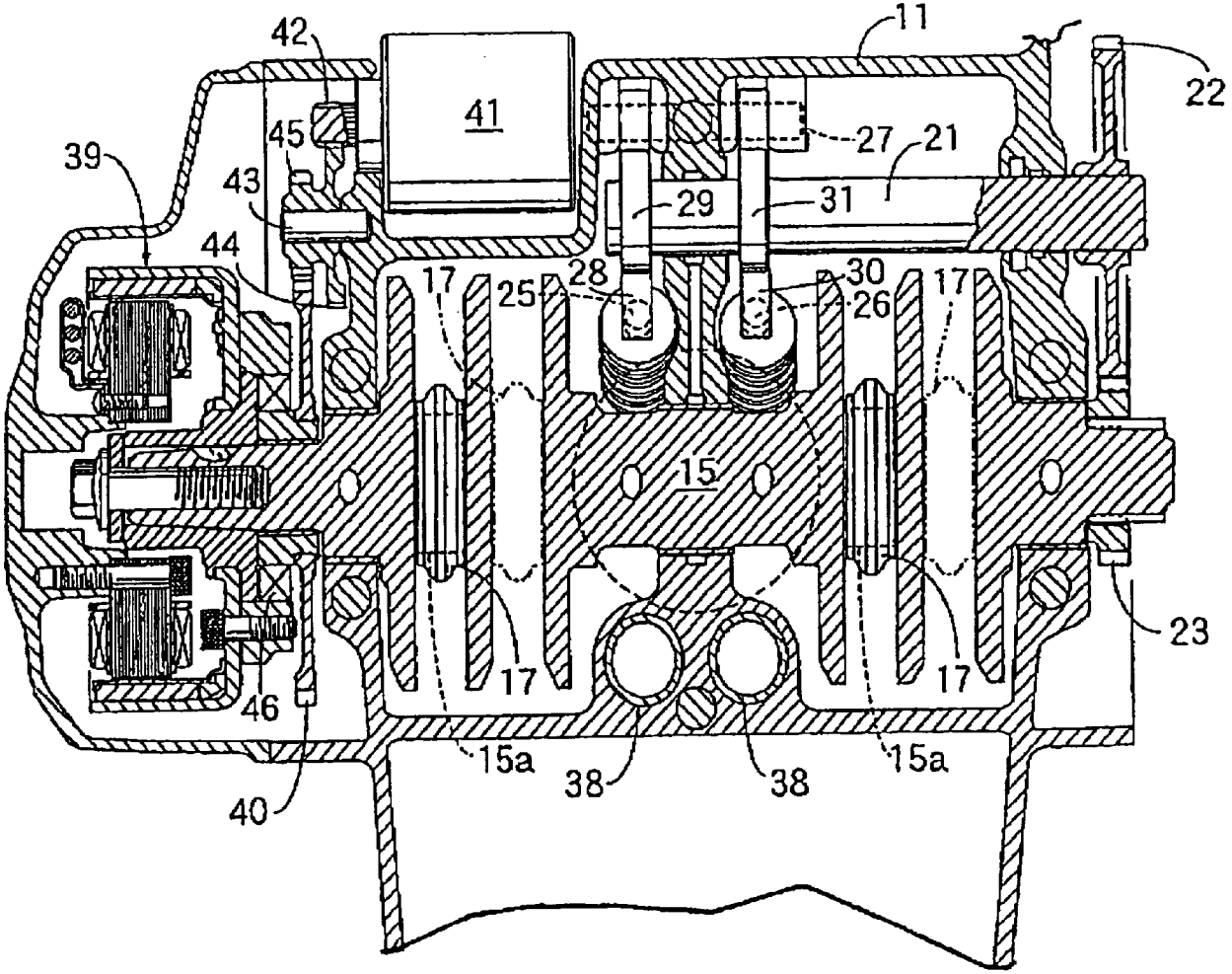
FIG. 10 is a vertical sectional view taken along line 3—3 of FIG. 8.
Figure 11:
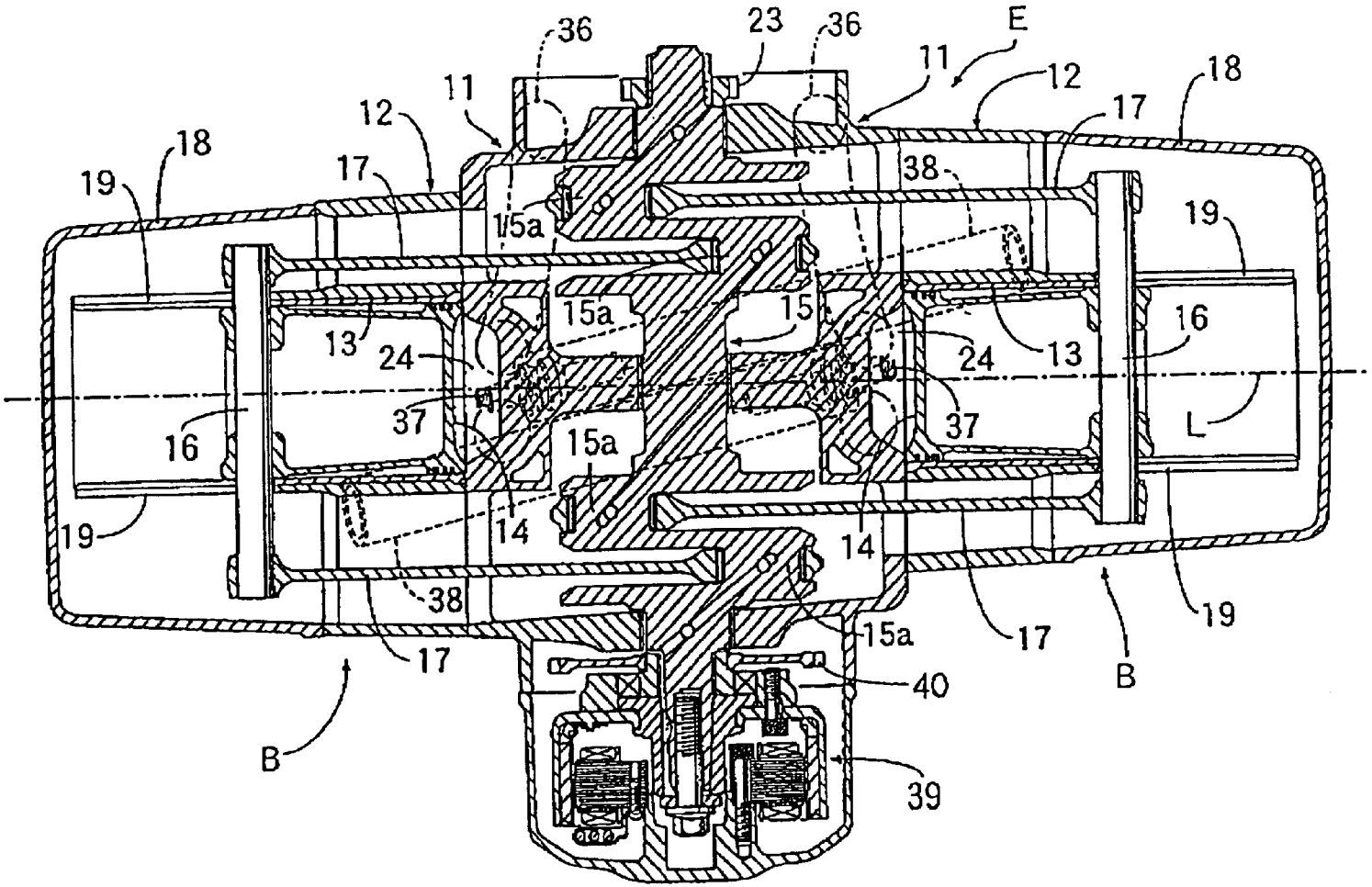
FIG. 11 is an operational view of an internal combustion engine in which a piston is located at top dead center.

FIGS. 8 to 12 show a second embodiment of the present invention. FIG. 8 is a vertical sectional view of a horizontally-opposed type internal combustion engine during an operating condition where a piston is located at bottom dead center. FIG. 9 is a vertical sectional view taken along line 2—2 of FIG. 8. FIG. 10 is a vertical sectional view taken along line 3—3 of FIG. 8. FIG. 11 is an operational view of an internal combustion engine in which a piston is located at top dead center. FIG. 12 is an operational view of an internal combustion engine according to the present invention.

As shown in FIGS. 1 to 4, a four-cycle, single-cylinder engine E for a motorcycle includes a left engine block 11 and a right engine block 12 bisected along left and right sides. A cylinder block 13 is clamped between the left and right engine blocks 11, 12. The cylinder block 13 includes a cylinder 14 and an auxiliary cylinder 15 disposed along a common axis L1. A piston 16 is slidably fitted in the cylinder 14, and an auxiliary piston 17 is slidably fitted in the auxiliary cylinder 15.

A ring-shaped support portion 17*c* is provided in the inside of a generally cylindrical main body portion 17*a* of the auxiliary piston 17 through a pair of arm portions 17*b*, 17*b*. An intermediate pin 18 is fitted in two through-holes 17*d*, 17*d* penetrating through the main body portion 17*a* and the support portion 17*c*. Both ends of the intermediate pin 18 are slidably fitted in a pair of slits 15*a*, 15*a* provided in the auxiliary cylinder 15 along the direction of the axis L1.

The upper end of a first connecting rod 19 extending in the direction of the axis L1 is connected to the piston 16 through a piston pin 20. A bifurcated lower end portion of the first connecting rod 19 is connected to the intermediate pin 18 in the inside of the auxiliary piston 17. The piston 16 and the auxiliary piston 17 are therefore moved as a unitary body through the first connecting rod 19, and the first connecting rod 19 is constantly maintained along on the axis L1 without oscillating.

A left crankshaft half 24 is rotatably supported on the left engine block 11 and by a left cover 21 connected to a left side surface thereof through two ball bearings 22, 23. A right crankshaft half 28 is rotatably supported on the right engine block 12 and by a right cover 25 connected to a right side surface thereof through two ball bearings 26, 27. The left crankshaft half 24 and the right crankshaft half 28 are located on a common axis L2 (See FIG. 1). A crank pin 29 provided on the left crankshaft half 24 and the left end of the intermediate pin 18 is connected by the second connecting rod 30. Similarly, a crank pin 31 provided on the right crankshaft half 28 and the right end of the intermediate pin 18 is connected by the second connecting rod 32.

A cylinder head 41 connected to the left engine block 11 and the right engine block 12 is provided with a combustion chamber 42 between a top surface of the piston 16 and a surface of the cylinder head 41. The cylinder head 41 also includes an intake port 43 and an exhaust port 44 extending from the combustion chamber 42, an intake valve 45 for opening and closing the intake port 43, and an exhaust valve 46 for opening and closing the exhaust port 44. An intake pipe 48 provided with a fuel injection valve 47 is connected to the intake port 43, and the combustion chamber 42 is provided with a spark plug 49.

A camshaft 52 is supported in a valve chamber 51 surrounded by the cylinder head 41 and a head cover 50. A driven sprocket 53 provided on the camshaft 52 is connected to a driving sprocket 54 provided on the left crankshaft half 24 through a timing chain 55.

An intermediate portion of an intake rocker arm 57 is rotatably supported on an intake rocker arm shaft 56 provided at the cylinder head 41. A first end of the intake rocker arm 57 makes contact with an intake cam 58 provided on the camshaft 52. The other end of the intake rocker arm 57 engages with a stem end of the intake valve 45. In addition, an intermediate portion of an exhaust rocker arm 60 is rotatably supported on an exhaust rocker arm shaft 59 provided at the cylinder head 41. A first end of the exhaust rocker arm 60 engages with an exhaust cam 61 provided on the camshaft 52, and the other end makes contact with a stem end of the exhaust valve 46.

A balancer shaft 64 is supported through a pair of ball bearings 62, 63 on the left engine block 11 and the left cover 21. An output shaft 67 is supported through ball bearings 65, 66. A first gear 68 provided on the left crankshaft half 24 is meshed with a second gear 69 provided on the balancer shaft 64, and a third gear 70 provided on the balancer shaft 64 is meshed with a fourth gear 71 provided on the output shaft 67. A sector-shaped balancer weight 72 (See FIGS. 1 and 3) is provided at the inner end of the balancer shaft 64, e.g., at a position adjacent to the cylinder 14. The first gear 68 and the second gear 69 have an equal number of gear teeth, so that the balancer shaft 64 is rotated at the same speed as the left crankshaft half 24. The output shaft 67 projecting from the left cover 21 is connected to an input shaft of a belt-type, direct drive (non-stage) transmission in a preferred embodiment.

A balancer shaft 75 is supported on the right engine block 12 and the right cover 25 through a pair of ball bearings 73, 74, and a fifth gear 76 provided on the right crankshaft half 28 is meshed with a sixth gear 77 provided on the balancer shaft 75. A sector-shaped balancer weight 78 (See FIGS. 1 and 2) is provided at the inner end of the balancer shaft 75, e.g., at a position adjacent to the cylinder 14. The fifth gear 76 and the sixth gear 77 have an equal number of teeth, so that the balancer shaft 75 is rotated at the same speed as the right crankshaft half 28. The right crankshaft half 28 is provided with a speed-detecting gear 80 positioned opposite to a pulser 79 for detecting the rotational frequency. As seen in FIG. 2, the engine E having the above-described structure includes a fitting portion 12*a* provided on the right engine block 12 supported by a vehicle body frame 83 through engine hangers 81, 82.

The action or effects of the above-described embodiment of the present invention will be described in greater detail hereinafter. The internal combustion engine E according to the present embodiment includes the cylinder 14, the piston 16 slidably fitted in the cylinder 14, an auxiliary piston 17 slidably fitted in the auxiliary cylinder 15 coaxial with the cylinder 14, the first connecting rod 19 for integrating the piston 16 and the auxiliary piston 17, the combustion chamber 42 provided in the cylinder head 41, the left and right crankshaft halves 24, 28, and two second connecting rods 30, 32 for connecting the auxiliary piston 17 to the left and right crankshaft halves 24, 28 through the intermediate pin 18. The left and right crankshaft halves 24, 28 are disposed along the outside of the piston 16 with respect to a radial direction thereof.

FIG. 5(*a*) shows a condition where the piston 16 is located at top dead center, e.g., when the crank angle θ is 0°. FIG. 5(*c*) shows a condition where the piston 16 is located at bottom dead center, e.g., when the crank angle θ is 180°. FIG. 5(*c*) shows the condition where the piston 16 is located at a middle point between top dead center and bottom dead center, e.g., when the crank angle θ is not 90°, but is an angle θb greater than 90°. Accordingly, while the second connecting rods 30, 32 are located on the axis L1 of the cylinder 14 at top dead center and bottom dead center, the second connecting rods 30, 32 are inclined by an angle ϕ with reference to the axis L1 of the cylinder 14 at the time of an intermediate piston position between top dead center and bottom dead center. In addition, the first connecting rod 19 merely integrates the piston 16 and the auxiliary piston 17 as a unitary body, and is therefore maintained without oscillation along the axis L1.

In FIG. 6, the relationship between the crank angle θ with reference to top dead center of the internal combustion engine E and the displacement x of the piston 16 with reference to top dead center is indicated by a broken line. Here, the stroke between top dead center and bottom dead center of the piston 16 is 2R (R is the crank radius). As has been described with reference to FIG. 5(*b*), when the piston 16 is located at the middle point (the point where the displacement is R) between top dead center and bottom dead center, the crank angle θ is the angle θb greater than 90°. In contrast, the crank angle θ is 90° when the piston 16 is located at the middle point between top dead center and bottom dead center, e.g., as seen in the sine curve indicated by a solid line.

Thus, in the internal combustion engine E according to this embodiment, the line (See the broken line) indicating the relationship of the displacement x of the piston 16 with the crank angle θ is located on the lower side of the sine curve indicated by the solid line, and it is seen that $x<R\sin(\theta-90°)+R$ is established with the present invention. When the piston is lowered from top dead center in an expansion stroke, the increase of the displacement x of the piston 16 with reference to the increase of the crank rangle θ is smaller then when compared to the characteristics of the sine curve.

As has been described above, in order to enhance thermal efficiency of the internal combustion engine E, it is desirable to enhance the equal volume degree at the time of combustion of a mixture gas. For this, the equal volume degree is higher and the thermal efficiency is higher as the increase of the volume of the combustion chamber 42 with reference to the increase of the crank angle θ is smaller when the piston 16 is lowered from top dead center in the expansion stroke.

As seen in the expansion stroke portion with the crank angle θ from 0° to 180° in FIG. 6, the displacement x of the piston 16 from top dead center of the internal combustion engine E according to the present embodiment indicated by the broken line is smaller than the displacement x of the internal combustion engine E of the background art indicated by the chain line. Therefore, the equal volume degree in the expansion stroke and thermal efficiency is enhanced.

In addition, since the auxiliary piston 17 is moved away from the left and right crankshaft halves 24, 28 during the expansion stroke in which the largest load is exerted on the first and second connecting rods 19, 30, 32, an advantageous tensile load is achieved that is opposite to the load exerted on the second connecting rods 30, 32 in the case of the internal combustion engine E of the background art. More particularly, the exertion of the tensile load on the second connecting rods 30, 32 in the present invention is advantageous since it provides more strength than the case of the exertion of a compressive load experienced with the internal combustion engine E of the background art. Accordingly, it is possible to make the second connecting rods 30, 32 of the present invention relatively slender and to thereby achieve a reduction in overall weight.

Since the left and right crankshaft halves 24, 28 are disposed on the outside in the radial direction of the range of sliding of the piston 16 of the cylinder 14, it is possible to reduce the size of the internal combustion engine E in the direction of the axis L1 of the cylinder 14. Accordingly, it is possible to achieve a concentration of mass.

In addition, even though the crankshaft is bisected into the left and right crankshaft halves 24, 28 and disposed on both sides of the cylinder 14, the two second connecting rods 30, 32 disposed on both sides of the cylinder 14 are connected respectively to the left and right crankshaft halves 24, 28. It is also possible to avoid exertion of an unbalanced load on the auxiliary piston 17, the piston 16 and the first and second connecting rods 19, 30, 32 and to prevent generation of abnormal wear.

Any interference of the left and right crankshaft halves 24, 28 with the cylinder 14 is simultaneously avoided with the present invention. The balancer weights 72, 78 rotated in conjunction with the left and right crankshaft halves 24, 28 are disposed in the surrounding of the cylinder 14 and it is therefore possible to concentrate the mass of the balancer weights 72, 78 in the surrounding of the cylinder 14 and to enhance a vibration-damping effect.

While the embodiment of the present invention has been described in detail hereinabove, the present invention includes various design modifications within the spirit and scope of the invention. For example, the internal combustion engine E for a motorcycle can be applied to multi-cylinder and/or other internal combustion engine applications for other vehicles and engine applications.

In addition, while the engine E according to the embodiment comprises the left and right crankshaft halves 24, 28 on both sides of the cylinder 14, a structure may be adopted in which either one of the left and right crankshaft halves 24, 28 is provided. While the 4-cycle internal combustion engine E has been described as an example in the foregoing embodiments, the present invention may also be applied to an overhead valve type, 2-cycle internal combustion engine.

As described above, according to an embodiment of the invention, the crankshaft is disposed on the outside in the radial direction of the piston sliding range of the cylinder. Therefore, it is possible to reduce the size of the internal combustion engine in the axial direction of the cylinder and to achieve a concentration of mass when compared with the conventional internal combustion engine in which the crankshaft is provided on the outside on the axis of the cylinder and on the outside of the piston sliding range.

In addition, the connecting rod is split into the first connecting rod having one end connected to the piston side and the second connecting rod having one end connected to the crankshaft side, and the other ends of both of the connecting rods are connected to each other through the intermediate pin moved in the axial direction of the cylinder. In contrast to the conventional internal combustion engine having the crankshaft provided on the axis of the cylinder and on the outside of the piston sliding range, the increase of the volume of the combustion chamber corresponding to the increase of the crank angle with reference to top dead center of the piston can be reduced with the present invention. Accordingly, it is possible to enhance the equal volume degree at the time of combustion of a mixture gas and to enhance thermal efficiency.

In addition, the pair of crankshaft halves bisected with the cylinder therebetween is connected respectively to both ends of the intermediate pin through the second connecting rod. Therefore, it is possible to avoid exertion of an unbalanced load on the piston and the first and second connecting rods. Further, the present invention prevents the generation of abnormal wearing, while avoiding an interference of the crankshaft with the cylinder.

The balancer weights provided on the balancer shafts rotated in conjunction with the crankshaft are advantageously disposed in the surroundings of the cylinder. Therefore, it is possible to concentrate the mass of the balancer weights in the surrounding of the cylinder and to enhance a vibration-damping effect.

A second embodiment of the present invention will be described hereinafter with respect to FIGS. 8–12 of the accompanying drawings. FIGS. 8 to 12 show a second embodiment of the present invention. FIG. 8 is a vertical sectional view of a horizontally-opposed type internal combustion engine during an operating condition where a piston is located at bottom dead center. FIG. 9 is a vertical sectional view taken along line 2—2 of FIG. 8. FIG. 10 is a vertical sectional view taken along line 3—3 of FIG. 8. FIG. 11 is an operational view of an internal combustion engine in which a piston is located at top dead center. FIG. 12 is an operational view of an internal combustion engine according to the present invention.

As shown in FIGS. 8 to 10, the horizontally-opposed type two-cylinder internal combustion engine E having left and right banks B, B includes left and right bisected cylinder heads 11, 11, left and right cylinder blocks 12, 12 connected to the outside of the cylinder heads 11, 11, left and right cylinders 13, 13 supported in the inside of the cylinder blocks 12, 12, left and right pistons 14, 14 slidably fitted withn the cylinders 13, 13, and a crankshaft 15 supported at a split surface of the left and right cylinder heads 11, 11. Two pairs of left and right connecting rods 17 for connecting piston pins 16, 16 supported at outer ends of the pistons 14, 14 to crank pins 15*a*, and cup-shaped covers 18, 18 for covering outer end portions of the cylinder blocks 12, 12 are included in the engine E.

The left and right cylinders 13, 13 are not offset in the axial direction of the crankshaft 15, but are located on a common axis L (See FIG. 9). An outer end portion of each cylinder block 12 and cylinder 13 is provided with two slits 19, 19 extending in the direction of the axis L, and the piston pin 16 is slidably guided by the slits 19, 19. A driven gear 22 provided at a single camshaft 21 supported at a mating surface of the left and right cylinder heads 11, 11 is meshed with a driving gear 23 provided at one end of the crankshaft 15. The camshaft 21 is rotated at one half of the rotational frequency of the crankshaft 15.

A combustion chamber 24 provided at the cylinder head 11 of each bank B is provided with an intake valve 25 and an exhaust valve 26. An intake rocker arm 28 rotatably supported on a rocker arm shaft 27 fixed to the cylinder head 11 engages with stem ends of an intake valve 25 and an intake cam 29 provided at the camshaft 21. An exhaust rocker arm 30 rotatably supported on the rocker arm shaft 27 makes contact with stem ends of an exhaust valve 26 and an exhaust cam 31 provided at the camshaft 21.

The upstream side of an intake port 32 opened and closed by the intake valve 25 is connected to a throttle valve 33. A fuel injection valve 34 is provided directly under the throttle valve 33. An exhaust port 35 opened and closed by the exhaust valve 26 is connected to an exhaust pipe 36. A guide tube 38 for detachably fitting a spark plug 37 engaging with the combustion chamber 24 extends from the cylinder block 12 of the bank B on the opposite side in a skewed orientation.

As seen in FIG. 9, the left and right guide tubes 38, 38 are not parallel with the axes L of the cylinders 13, 13 in plan view, and their opening end sides are inclined to both end sides of the crankshaft 15. With this layout, it is unlikely that the guide tubes 38, 38 will interfere with the lower surfaces of the cylinder blocks 12, 12. As a result, it is possible to reduce the inclination angle of the downward inclination of the opening end sides of the guide tubes 38, 38 relative to the axes L of the cylinders 13, 13 in FIG. 6. Accordingly, the engine E according to the present invention can incorporate the aforementioned features and achieve an advantageous reduction in overall size.

An AC generator 39 and a starter gear 40 are provided on the other end of the crankshaft 15. The engine E is started by a driving force of a pinion 42 provided on a starter motor 41 transmitted to the crankshaft 15 through intermediate gears 44, 45 supported on an intermediate shaft 43, the starter gear 40, a one-way clutch 46 and the ACgenerator 39.

FIG. 12 schematically shows the bank B on one side of the internal combustion engine E according to the second embodiment of the present invention. The internal combustion engine E of the present includes a cylinder 13, a piston 14 slidably fitted in the cylinder 13, a cylinder head 11 connected to the cylinder 13, a combustion chamber 24 formed in the cylinder head 11 and by the piston 14, a crankshaft 15, and connecting rods 17, 17 for connecting the piston 14 to the crankshaft 15. The cylinder head 11 is disposed at a position between the piston 14 and the crankshaft 15.

FIG. 12(*a*) shows a condition where the piston 14 is located at top dead center, e.g., when the crank angle θ is 0°. FIG. 12(*c*) shows a condition where the piston 14 is located at bottom dead center, e.g., when the crank angle is 180°. FIG. 12(*b*) shows a condition where the piston 14 is located at an intermediate point between top dead center and bottom dead center, e.g., when the crank angle θ is not 90° but is an angle θb greater than 90°.

While the connecting rods 17, 17 are located on the axis L of the cylinder 13 at top dead center and bottom dead center, the connecting rods 17, 17 are inclined by an angle ϕ with reference to the axis L of the cylinder 13 at the time of the intermdiate point.

Since the left and right combustion chambers 24, 24 are concentrated at a central portion of the engine E, the intake system, e.g., such as the fuel injection valves 34, 34 and the throttle valves 33, 33 connected to the combustion chambers 24, 24, can be laid out in a compact form, and the pipe length of the intake pipes can be shortened. Further, the noise generated from the combustion chambers 24, 24 and the valve mechanisms 20, 20 is less likely to leak to the exterior of the engine E. In addition, relatively heavy members can be concentrated at a central portion of the engine E.

Since the valve mechanisms 20, 20 of the left and right banks B, B are driven by the common camshaft 21 provided at the center of the left and right cylinder heads 11, it is possible to minimize the number of required camshafts 21. This reduces the number of component parts and achieves a reduction in size of the engine E. Since the common camshaft 21 is disposed between the intake port 32 and the exhaust port 35 of the left bank B and the intake port 32 and the exhaust port 35 of the right bank B, it is possible to effectively utilize the dead space between the left and right intake ports 32, 32 and the dead space between the left and right exhaust ports 35, 35, respectively.

Moreover, since the camshaft 21 is disposed in proximity to the crankshaft 15, a timing chain or a timing belt in the power transmission system from the crankshaft 15 to the camshaft 21 is not required, and it is possible to make the power transmission system compact and to further reduce the number of required component parts.

In addition, since the opposed cylinders 13, 13 of the left and right banks B, B are located on the common axis L, e.g., the offset in the axial direction of the crankshaft 15 is avoided, it is possible to suppress the generation of an inertia couple of forces attendant on the reciprocation of the pistons 14, 14 and to reduce the vibration of the engine E.

While the second embodiment of the present invention has been described in detail hereinabove, the present invention allows various design modifications within the spirit and scope of the invention. For example, while a 4-cycle internal combustion engine E has been described as an example in the embodiment, the present invention can be applied also to a 2-cycle internal combustion engine. In addition, while the cylinders 13, 13 of the left and right banks B, B are disposed on a common axis L in the embodiment, the axes L, L of the left and right cylinders 13, 13 may be offset from each other in the case of a small-type engine E in which generation of an inertia couple of forces is not as critical.

While the two left and two right connecting rods 17 of the left and right banks B, B are alternately disposed on the inner and outer sides in the above-described embodiment, the two connecting rods 17, 17 of one bank B may be disposed on the inside with respect to the axial direction of the crankshaft 15. The two connecting rods 17, 17 of the other bank B may be disposed on the outside with respect to the axial direction of the crankshaft 15. In addition, while the two-cylinder horizontally-opposed type internal combustion engine E has been described in the embodiment, the present invention can be applied also to a four-cylinder (or other multi-cylinder) horizontally-opposed type internal combustion engine E.

Thus, according to the second embodiment of the present invention the increase of the volume of the combustion chamber corresponding to the increase of the crank angle with reference to top dead center of the piston can be reduced, e.g., as compared with the horizontally-opposed type internal combustion engine of the background art in which the left and right combustion chambers are provided on the outside of the left and right cylinders.

Accordingly, it is possible to enhance the equal volume degree at the time of combustion of the mixture gas and to enhance thermal efficiency. In addition, since a tensile load is exerted on the connecting rods during the expansion stroke, the typical considerations of buckling are unnecessary in contrast to the internal combustion engine of the background art where a compressive load is experienced. Therefore, it is possible to reduce the required strength of the connecting rods and to thereby reduce the weight thereof.

Since the left and right combustion chambers are concentrated at a central portion of the engine, a compact layout of the intake systems connected to the combustion chambers is achieved. Further, it is difficult for the noise generated from the combustion chambers and the valve mechanisms adjacent thereto to leak to the exterior. Typically heavier members can be concentrated at central portions of the engine and engine size is reduced.

A common camshaft disposed between the left and right cylinders is used for the valve mechanisms of the left and right banks. Therefore, it is possible to minimize the number of required camshafts. The axes of the opposed cylinders of the left and right banks are generally disposed coaxially. Therefore, it is possible to suppress the generation of an inertia couple of forces attendant on the reciprocation of the pistons, and to reduce the vibration of the engine.

In addition, the camshaft disposed between the intake passages or between the exhaust passages of the left and right banks aids in effectively utilizing the dead space between the left and right intake passages or the dead space between the left and right exhaust passages and to therefore reduce the size of the engine. The guide tube for detachably fitting the spark plug is inclined to a shaft end side of the crankshaft with reference to the axes of the cylinders. Therefore, the guide tube is unlikely to interfere with the cylinders, in contrast to the case where the guide tube is disposed directly under or directly over the axes of the cylinders. Accordingly, it is possible to reduce the angle of vertical inclination of the guide tube so as to part from the axes of the cylinders for avoiding interference with the cylinders and to reduce the size of the engine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine comprising:

a cylinder;

a cylinder head;

a piston slidably fitted in the cylinder;

an auxiliary cylinder coaxial with the cylinder;

an auxiliary piston slidably fitted in the auxiliary cylinder;

a first connecting rod integrating the piston and the auxiliary piston into a single unitary body;

a combustion chamber provided in the cylinder head;

a pair of left and right crankshaft halves; and a pair of second connecting rods connecting the auxiliary piston to the left and right crankshaft halves through an intermediate pin, wherein the left and right crankshaft halves are disposed adjacent to and along the outside of the cylinder with respect to a radial direction of said cylinder, and within a piston sliding range of said cylinder.

2. The internal combustion engine according to claim 1, further comprising balancer weights provided on balancer shafts, wherein said balancer shafts being driven by said crankshaft are disposed in the surrounding of said cylinder.

3. An internal combustion engine comprising:

a piston slidably fitted in a cylinder;

a combustion chamber;

a crankshaft; and a connecting rod connecting said piston to the crankshaft, wherein said crankshaft is positioned adjacent to and along an outside of said combustion chamber and within a piston sliding range of said cylinder with respect to a radial direction of said cylinder.

4. The internal combustion engine according to claim 3, wherein said connecting rod comprises a first connecting rod having a first end connected to said piston and a second connecting rod having a first end connected to said crankshaft, and the second end of said first connecting rod and the second end of said second connecting rod being connected to each other through an intermediate pin moved in the direction of the axis of said cylinder.

5. The internal combustion engine according to claim 3, wherein said crankshaft comprises a pair of crankshaft halves bisected with said cylinder therebetween, and said crankshaft halves being connected respectively to both ends of said intermediate pin through said second connecting rod.

6. The internal combustion engine according to claim 4, wherein balancer weights provided on balancer shafts driven by said crankshaft are disposed in the surrounding of said cylinder.

7. The internal combustion engine according to claim 5, wherein balancer weights provided on balancer shafts driven by said crankshaft are disposed in the surrounding of said cylinder.

8. The internal combustion engine according to claim 4, wherein said crankshaft comprises a pair of crankshaft halves bisected with said cylinder therebetween, and said crankshaft halves are connected respectively to both ends of said intermediate pin through said second connecting rod.

9. The internal combustion engine according to claim 8, wherein balancer weights provided on balancer shafts driven by said crankshaft are disposed in the surrounding of said cylinder.

10. An internal combustion engine comprising:

a piston slidably fitted in a cylinder;

a combustion chamber;

a crankshaft;

a connecting rod connecting said piston to the crankshaft, wherein said crankshaft is positioned adjacent to and along an outside of said combustion chamber and within a piston sliding range of said cylinder with respect to a radial direction of said cylinder; and balancer weights provided on balancer shafts driven by said crankshaft, wherein said balancer weights are disposed in the surrounding of said cylinder.

* * * * *